US008133060B2

(12) United States Patent
Wadsworth

(10) Patent No.: US 8,133,060 B2
(45) Date of Patent: Mar. 13, 2012

(54) ELECTRIC PLUG AND METHODS OF PROVIDING THE SAME

(75) Inventor: John F. Wadsworth, Los Angeles, CA (US)

(73) Assignee: Belkin International, Inc., Playa Vista, CA (US)

( * ) Notice: Subject to any disclaimer, the term of this patent is extended or adjusted under 35 U.S.C. 154(b) by 313 days.

(21) Appl. No.: 12/613,513

(22) Filed: Nov. 5, 2009

(65) Prior Publication Data

US 2010/0285687 A1 Nov. 11, 2010

Related U.S. Application Data

(60) Provisional application No. 61/111,373, filed on Nov. 5, 2008.

(51) Int. Cl.
*H01R 39/00* (2006.01)

(52) U.S. Cl. ..... 439/21; 439/13; 439/106

(58) Field of Classification Search ..... 439/11, 439/13, 20–28, 106
See application file for complete search history.

(56) References Cited

U.S. PATENT DOCUMENTS

| | | | | |
|---|---|---|---|---|
| 1,984,181 | A | 12/1934 | French | |
| 2,425,679 | A | 8/1947 | Jackson | |
| 2,542,935 | A | 2/1951 | McElroy | |
| 2,570,784 | A | 10/1951 | Ferguson | |
| 2,654,869 | A | 10/1953 | Mudd, Jr. | |
| 2,898,572 | A | 8/1959 | Shinn | |
| 3,335,395 | A * | 8/1967 | Smith | 439/466 |
| 3,718,890 | A | 2/1973 | Sheldon | |
| 3,760,338 | A * | 9/1973 | Bruels | 439/694 |
| 3,950,069 | A | 4/1976 | Wiley | |
| 5,114,352 | A | 5/1992 | Gahagen et al. | |
| 5,595,503 | A | 1/1997 | Pittman et al. | |
| 5,775,921 | A | 7/1998 | Chou | |
| 7,255,568 | B1 * | 8/2007 | Wu | 439/23 |
| 2010/0285687 | A1 * | 11/2010 | Wadsworth | 439/460 |

* cited by examiner

*Primary Examiner* — James Harvey
(74) *Attorney, Agent, or Firm* — Bryan Cave LLP

(57) ABSTRACT

In one embodiment, an electric plug can comprise a housing, a rotatable plug assembly, and a blade array. The housing can have a bottom piece and a top piece including a first opening. The bottom piece can be in mechanical communication with the top piece and forming a cavity defined by the interior surface of the top piece and the interior surface of the bottom piece. The rotatable plug assembly can have a top surface and a bottom surface opposite each other, where a first portion of the rotatable plug assembly can comprise the bottom surface and be located within the cavity, and where a second portion of the rotatable plug assembly can protrude from the cavity via the first opening. The blade array can include a plurality of plug blades, each plug blade of the plurality of plug blades having an outlet end and a connector end, the connector end of each plug blade located within the rotatable plug assembly. A power cord with a plurality of wires can be configured to pass through the second opening of the cavity, where the end of each wire can be located within the rotatable plug assembly and configured to mechanically couple to and be in electrical communication with the connector end of an associated one of the plurality of plug blades. Other embodiments and related examples are disclosed herein.

20 Claims, 5 Drawing Sheets

ELECTRIC PLUG AND METHODS OF PROVIDING THE SAME

CROSS REFERENCE TO RELATED APPLICATION

This application claims priority to U.S. Provisional Patent Application 61/111,373, filed on Nov. 5, 2008, the contents of which are incorporated herein by reference.

FIELD OF THE INVENTION

The present invention relates generally to an electrical plug and, more particularly, to an electrical plug having a low profile housing and a rotatable electrical cord.

BACKGROUND

Conventional electrical plugs can be undesirable because they typically include a housing designed to protrude a substantial distance from the outlet surface, such as, for example a wall when the plug is inserted into a wall outlet contained with the wall. This protrusion causes the plug to be susceptible to unintentional disengagement by: objects moving near the wall outlet, such as, for example persons or objects a person may be carrying; objects being placed close to the wall, such as, for example furniture, computing equipment, consumer electronics and the like; or any such other objects that may come into close proximity to a wall outlet.

Many varieties of electrical plugs have been developed which have low profile housings. These electrical plugs with low profile housings are advantageous because they have a reduced housing profile in comparison to conventional electrical plugs. As such, electrical plugs with low profile housings can be less susceptible to unintentional disengagement and may permit objects to be placed closer to a wall outlet, and therefore its associated wall, than is possible with conventional plugs.

Most electrical plugs with low profile housings include a power cord that exits the plug perpendicular to the prongs of the plug so as to decrease the profile of plug's housing. Therefore, when the plug is inserted into a wall outlet, the power cord exits the plug housing parallel to the face of the wall outlet. Unfortunately, this configuration may prove undesirable because it is possible for the cord to block other receptacles in the outlet after it exits the low profile housing. Blocking receptacles prevents additional plugs from being inserted into the outlet. This is even more of a problem with polarized plugs or plugs incorporating a ground prong since these plugs can only be inserted into the wall outlet in a single orientation. Additionally, many current solutions involving lower profile housings include numerous moving parts that increase the cost of the plug device as well as introduce additional failure points into the power distribution system.

Therefore, a need exists in the art to develop electrical plugs with low profile housings, higher reliability and include a reduction in cost, and related methods thereto that address such limitations of the current technology.

BRIEF DESCRIPTION OF THE DRAWINGS

The invention will be better understood from a reading of the following detailed description of examples of embodiments, taken in conjunction with the accompanying figures in the drawings in which.

Figure 1:
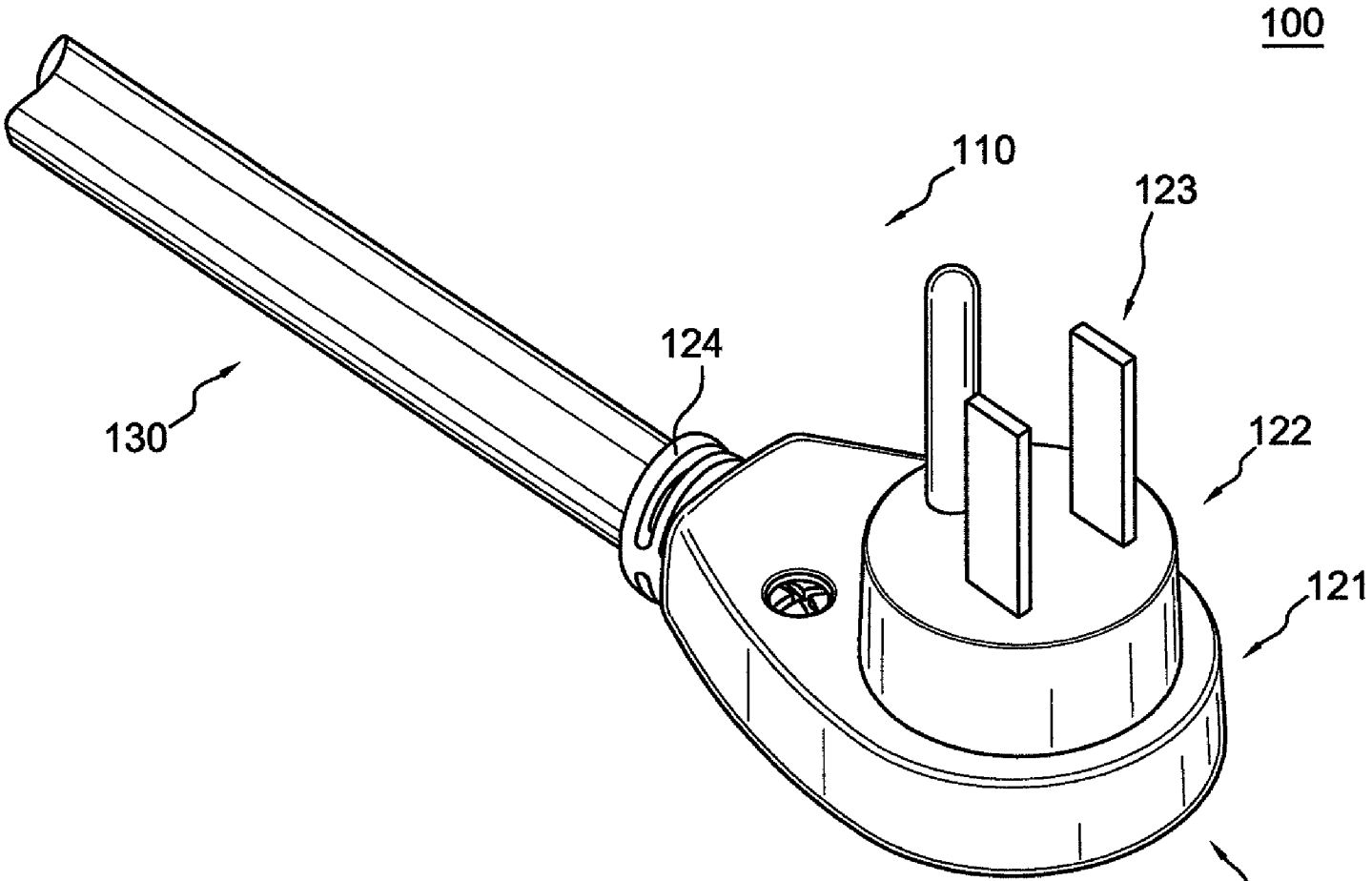
FIG. 1 illustrates an isometric top view of an embodiment of an exemplary rotatable electric plug, in accordance with the subject matter described herein.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types. The absence of the word "removably," "removable," and the like near the word "coupled," and the like does not mean that the coupling, etc. in question is or is not removable.

DETAILED DESCRIPTION

In one embodiment, an electric plug can include: (a) a housing having: (1) a top piece having an interior surface and an exterior surface and including a first opening; (2) a bottom piece having an interior surface and an exterior surface, the bottom piece in mechanical communication with the top piece and forming a cavity defined by the interior surface of the top piece and the interior surface of the bottom piece, the cavity including a second opening; (3) a rotatable plug assembly substantially rectangularly configured and having a top surface and a bottom surface, a first portion of the rotatable plug assembly associated with the bottom surface located within the cavity, a second portion of the rotatable plug assembly protruding from the first opening; and (4) a blade array including a plurality of plug blades, each plug blade of the plurality of plug blades having an outlet end and a connector end, the connector end of each plug blade located within the rotatable plug assembly, a portion of a remainder portion of each plug blade exiting the top surface of the rotatable plug assembly; and (b) a power cord configured to pass through the second opening of the cavity, the power cord having a plurality of wires, each wire the plurality of wires including an end, the end of each wire located within the rotatable plug assembly and configured to mechanically couple to and be in electrical communication with the connector end of an associated one of the plurality of plug blades.

In another embodiment, an electric plug can include: (a) an electrically insulative top shell, the electrically insulative top shell including a circular opening; (b) an electrically insulative bottom shell mechanically coupled to the electrically insulative top shell, the coupling of the electrically insulative top shell and the electrically insulative bottom shell forming an interior cavity and a power cable hole; (c) a dynamic plug assembly means within the interior cavity, the dynamic plug assembly means in rotatable communication with the circular opening of the electrically insulative top shell and configured to receive a power cable and facilitate the coupling of the power cable to a plurality of plug blades partially located within the dynamic plug assembly; (d) a blade array including the plurality of plug blades, each plug blade of the plurality of plug blades having an outlet end and a connector end, the connector end of each plug blade located within the dynamic plug assembly means, a portion of a remainder portion of each plug blade exiting a top surface of the dynamic plug assembly means; and (e) the power cable configured to pass through the power cable hole into the interior cavity, the power cable having a plurality of wires, each wire of the plurality of wires including an end, the end of each wire located within the dynamic plug assembly means and configured to mechanically couple to and be in electrical communication with the connector end of an associated one of the plurality of plug blades.

Other embodiments include a method of providing an electric plug. The method can include: providing plug elements; coupling wires of a power cable to blade contacts; forming a rotatable plug assembly having a blade array including the blade contacts and plug blades; passing a top surface of the rotatable plug assembly through a first opening of a top piece of a housing; positioning a bottom surface of the rotatable plug assembly over a bottom piece of the housing that includes an enclosure configured to receive the bottom surface of the rotatable plug assembly and a tab stop configured to limit a rotation of the rotatable plug assembly; and coupling the bottom piece of the housing to the top piece of the housing so that a second opening is formed between the bottom piece of the housing to the top piece of the housing so that the power cable passes through the second opening.

Turning to the drawings, FIG. 1 illustrates an isometric top view of an embodiment of an exemplary rotatable electric plug system 100, in accordance with one embodiment of the subject matter described herein. System 100 is merely exemplary and is not limited to embodiments presented herein. System 100 can be implemented in many different embodiments or examples not presented herein.

In FIG. 1, rotatable electric plug system 100 includes rotatable electric plug head 110 that includes rotatable electric plug head 120 and power cable 130. Rotatable electric plug head 120 includes a housing 121, a rotatable plug assembly 122, a blade array 123 and strain relief 124.

Housing 121 includes a cavity and an opening configured to receive power cable 130. Strain relief 124 is configured to reduce strain on power cable 130 at the point where power cable 130 enters housing 121. Housing 121 additionally include a second opening that is configured to receive a portion of rotatable plug assembly 122. Rotatable plug assembly 122 is slidably coupled to and in rotatable communication with housing 121.

Blade array 123 is contained within rotatable plug assembly 122 with a portion of each of the blades of blade array 123 protruding from rotatable plug assembly 122 and configured to mechanical couple to and be in electrical communication with a power outlet. Each blade of blade array 123 is additionally configured to mechanical couple to and be in electrical communication with an associated portion of power cable 130 (detailed below). In some embodiments, this mechanical coupling occurs within rotatable plug assembly 122. Because rotatable plug assembly 122 is in rotatable communication with housing 121, blade array 123 includes a freedom of rotation of between approximately 270-300 degrees to interface with the aforementioned electric outlet (detailed below).

Figure 2:
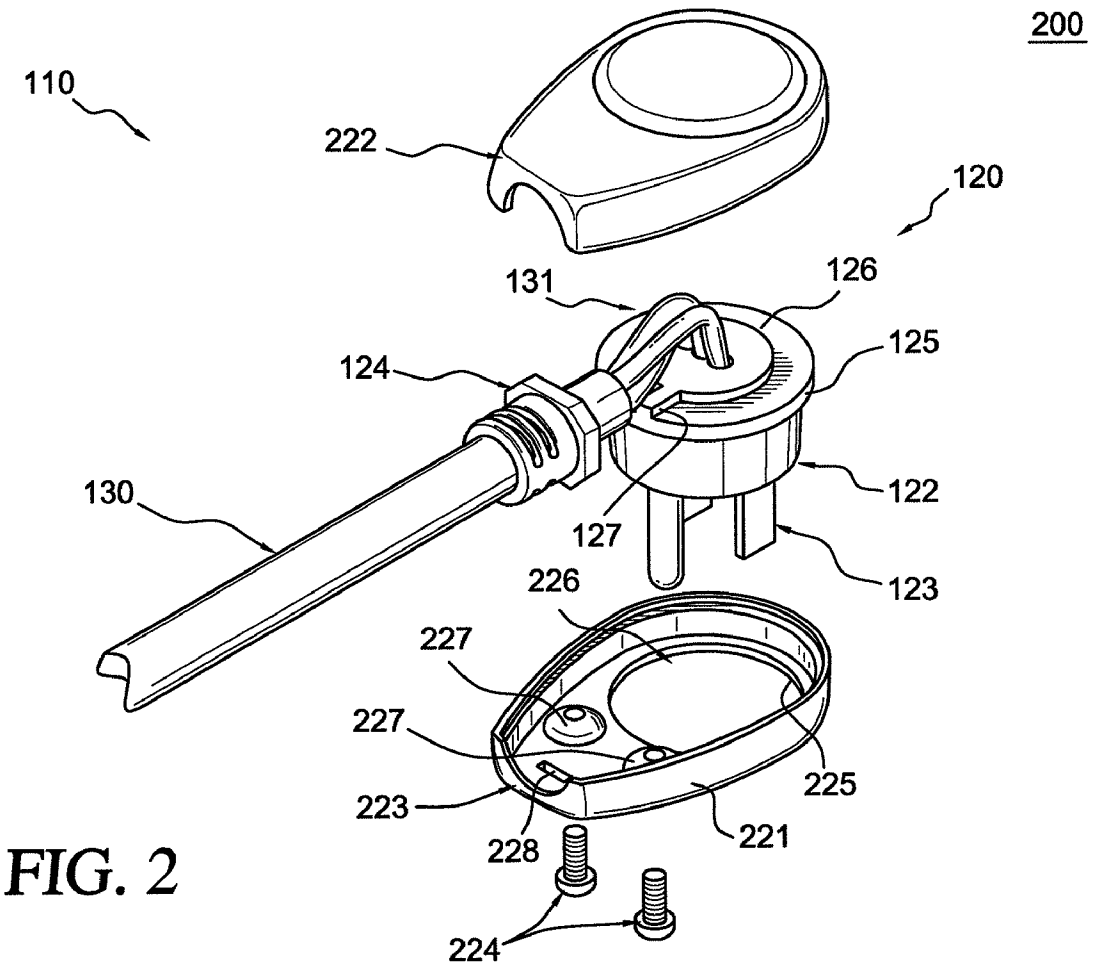
FIG. 2 illustrates an isometric partially-exploded right side view of the rotatable electric plug of FIG. 1, in accordance with the subject matter described herein.

FIG. 2 illustrates an isometric partially-exploded right side view of rotatable electric plug system 200, in accordance with one embodiment of the subject matter described herein. System 200 is merely exemplary and is not limited to embodiments presented herein. System 200 can be implemented in many different embodiments or examples not presented herein. Elements numbered as in FIG. 1 above function in a substantially similarly way.

In FIG. 2, rotatable electric plug head 110 includes top housing 221 having an opening that is disposed to contain rotatable plug assembly 122, and bottom housing 222 configured to mechanically couple to top housing 221 and thereby form a cavity to at least partially contain rotatable plug assembly 120 (via top opening 226) as well as a connecting end portion of power cable 130 (via side opening 223) within strain relief 124.

As described above, rotatable plug assembly 122 is located within the cavity formed by top housing 221 and bottom housing 222 and is further configured to contain a portion of blade array 123. Rotatable plug assembly 122 is configured to slidably fit within top opening 226 of top housing 221 and is further configured to occupy a portion of the cavity formed by top housing 221 and bottom housing 222. In one embodiment, the opening of top housing 221 is delimited by housing flange 225, where housing flange 225 is complementary with a top assembly flange 125 at the perimeter of rotatable plug assembly 122 to thereby restrict rotatable plug assembly 122 from exiting through top opening 226 of top housing 221. In other embodiments, rotatable plug assembly 122 includes a bottom assembly flange 126 to maintain alignment within bottom housing 222 (detailed in FIG. 3, below). In these embodiments, bottom assembly flange 126 can include a rotation limiting tab 127 that reduces the amount rotatable plug assembly 122 can rotate.

As described above, rotatable plug assembly 122 additionally includes blade array 123 having a plurality of plug blades. The plug blades are sized to be received within rotatable plug assembly 122, and configured such that a portion of each blade in blade array 123 is retained within the cavity formed by top housing 221 and bottom housing 222. Rotatable plug assembly 122 also includes components to mechanically couple each of the plug blades of blade array 123 to an associated wire of wiring harness 131 (detailed in FIG. 4, below). Power cable 130 includes the aforementioned wiring harness 131 that is located at an end portion of power cable 130 and includes a plurality of wires capable of providing power received from the plug blades of blade array 123 to a device in communication with another end portion of power cable 130. The excess portion of wiring harness 131 forms a service loop. Wiring harness 131 and the service loop are detailed below. In operation, each wire of wiring harness 131 is mechanically coupled to a portion of an associated plug blade of blade array 123 (detailed in FIG. 4, below).

As described above, the cavity formed by top housing 221 and bottom housing 222 additionally includes side opening 223 in communication with an upper strain relief area 228 configured to receive a portion of strain relief 124. Additionally, side opening 223 is sized to receive an end portion of power cable 130 passing through strain relief 124. Power cable 130 is configured to be slidably coupled to strain relief 124 and strain relief 124 is configured to allow power cable 130 to pass through it. In some embodiments, strain relief 124 is configured as a flexible tube including a cable securing portion configured to receive the exterior portion of power cable 130 such that power cable 130 is in slidable communication with the interior of strain relief 124. In such embodiments, strain relief 124 further includes a housing securing portion configured as a yoke to mechanically couple to the exterior of power cable 130 and to a point within the cavity formed by housing 221 and bottom housing 222, such that power cable 130 is in slidable communication with the interior of strain relief 124. In these embodiments, portions of power cable 130 are able to slide back-and-forth through strain relief 124 while strain relief 124 provides protection to power cable 130 when power cable 130 is pulled in a direction away from rotatable electric plug head 120.

In some embodiments, top housing 221 and bottom housing 222 are coupled together using an ultrasonic welding methodology that is further secured by screws 224 passing through entry holes 227 in top housing 221 and anchoring within bottom housing 222 (described in FIG. 3, below). In other embodiments, top housing 221 and bottom housing 222 are coupled using an adhesive methodology that is further secured by screws 224 as described above. In still other embodiments, top housing 221 and bottom housing 222 are coupled using a thermal methodology, such as using a hot-plate or laser technique, that is further secured by screws 224 as described above. In another embodiment, screws 224 are used without any welding, adhesive, or thermal techniques, or such welding, adhesive, and/or thermal techniques are used without screws 224. Top housing 221, bottom housing 222, and strain relief 124 can be manufactured from any suitable materials, such as, for example flame rated acrylonitrile butadiene styrene (ABS) plastic, as available from General Electric Co. In other examples, top housing 221, bottom housing 222, and strain relief 124 can be manufactured from any other rigid or semi-rigid flame rated thermoplastic materials, such as, for example, flame rated polycarbonate plastic or polystyrene plastic.

Figure 3:
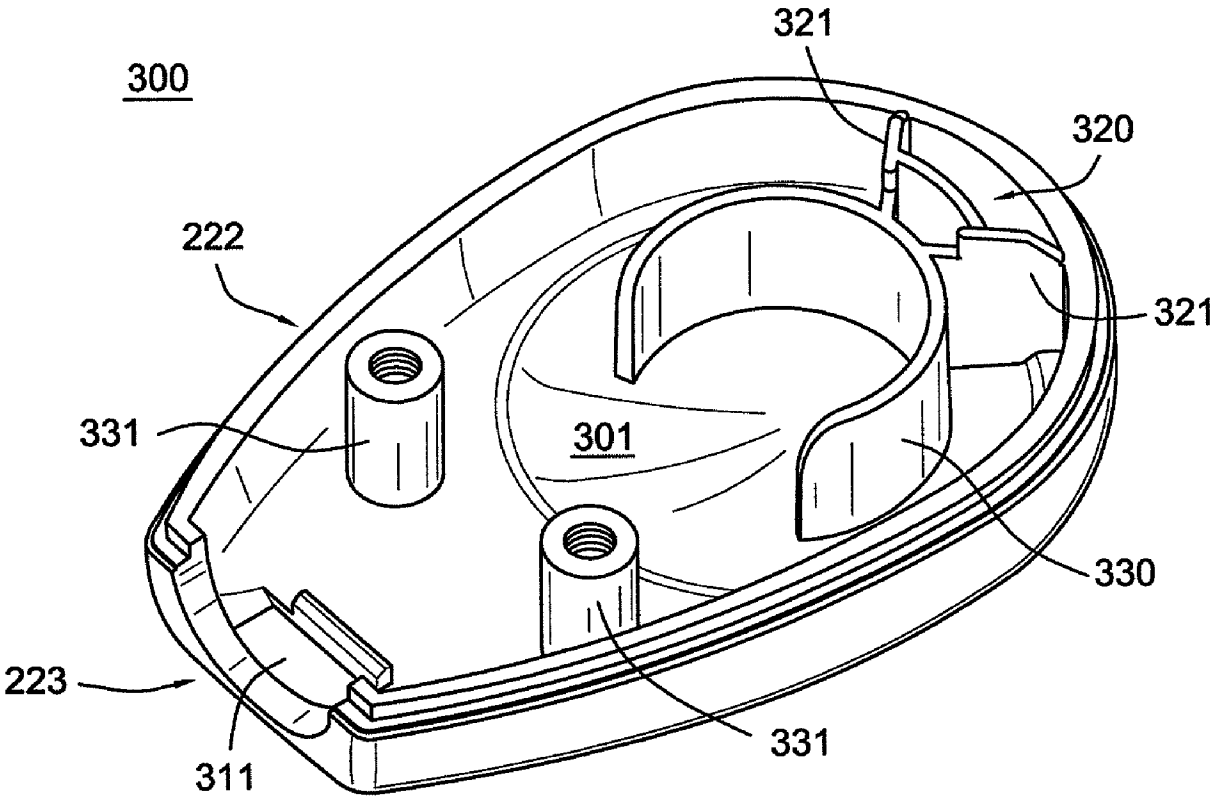
FIG. 3 illustrates an isometric interior view of the bottom housing portion of the rotatable electric plug of FIG. 1, in accordance with the subject matter described herein.

FIG. 3 illustrates an isometric interior view of a portion of rotatable electric plug system 300, in accordance with the subject matter described herein. System 300 is merely exemplary and is not limited to embodiments presented herein. System 300 can be implemented in many different embodiments or examples not presented herein. FIG. 3 details bottom housing 222 portion of rotatable electric plug 110 of FIGS. 1 and 2. Elements numbered as in FIGS. 1 and 2 above function in a substantially similarly way.

In FIG. 3, bottom housing 222 includes cavity 301 containing rotation limiting tab stop 320, service loop enclosure 330, screw attachment points 331 and lower strain relief area 311. Rotation limiting tab stop 320 includes rotation limiting tab stop facings 321. Screw attachment points 331 are configured to receive screws 224 via entry holes 227 within top housing 221 (FIG. 2, above). Lower strain relief area 311 is configured to form the strain relief area with upper strain relief area 228 of top housing 221 (FIG. 2, above). In one embodiment, when top housing 221 and bottom housing 222 are coupled together the strain relief area is configured to receive strain relief 124 (FIG. 2, above) that is slidably coupled to power cable 130 (FIG. 2, above).

Service loop enclosure 330 is configured to receive bottom assembly flange 126, to contain and protect service loop portion of wiring harness 131 (FIG. 2, above) associated with power cable 130, and to allow rotatable plug assembly 122 (FIG. 2, above) to rotate within the cavity defined by top housing 221 and bottom housing 222 to the extent permitted by the length of the service loop portion of wiring harness 131 and the positioning of rotation limiting tab stop facings 321 within bottom housing 222. In some embodiments, rotation limiting tab stop 320, rotation limiting tab stop facings 321, screw attachment points 331 and service loop enclosure 330 are manufactured as part of bottom housing 222. In these embodiments, the elements described immediately above can be manufactured as described above with respect to bottom housing 222.

In operation, a combination of rotation limiting tab stop facings 321 of rotation limiting tab stop 320 within bottom housing 222 interacting with rotation limiting tab 127 (FIG. 4, below) of rotatable plug assembly 122 allows rotatable plug assembly 122 to rotate approximately 270-300 degrees within the cavity created by bottom housing 222 and top housing 221. In other embodiments, rotation limiting tab stop facings 321 and/or rotation limiting tab 127 (FIG. 4, below) have a different configuration to allow rotatable plug assembly 122 to rotate a different amount, such as, for example, approximately 90 degrees, approximately 180 degrees, or any other angle.

Because the wires of wiring harness 131 (FIG. 2, above) are mechanically coupled to the top portion of rotatable plug assembly 122, the wires of wiring harness 131 are substantially perpendicular to the angular movement of rotatable plug assembly 122 within the cavity created by bottom housing 222 and top housing 221. Additionally, because the service loop portion of wiring harness 131 (FIG. 2) is located within service loop enclosure 330 and because the rotation of rotatable plug assembly 122 is limited by rotation limiting tab 127 and rotation limiting tab stop facings 321, a large angular rotation is achieved as well as a reduction of strain on the wires of wiring harness 131 (FIG. 2).

Figure 4:
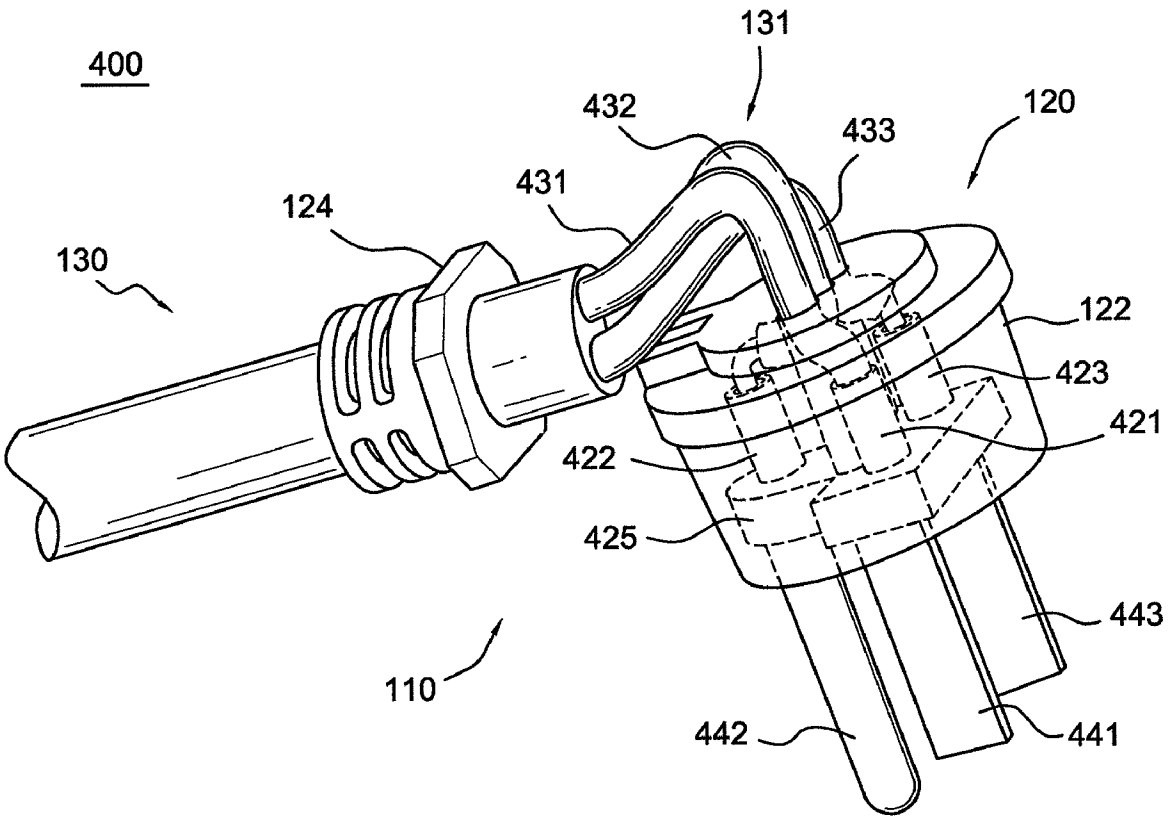
FIG. 4 illustrates an isometric translucent right side view of the rotatable electric plug of FIG. 1, in accordance with the subject matter described herein.

FIG. 4 illustrates an isometric translucent right side view of rotatable electric plug system 400, in accordance with the subject matter described herein. System 400 is merely exemplary and is not limited to embodiments presented herein. System 400 can be implemented in many different embodiments or examples not presented herein. Elements in FIG. 4 that are similarly numbered in previous Figures perform in substantially similar ways.

In FIG. 4, rotatable plug assembly 122 is illustrated as a transparent element and includes plug blades 441-443 and blade contacts 421-423, wherein each blades of the plug blades 441-443 is mechanically coupled and in electrical communication with an associated one of blade contacts 421-423. Additionally, rotatable plug assembly 122 includes a contact carrier 425 including slots for receiving plug blades 441-443 and associated blade contacts 421-423. In some embodiments, contact carrier 425 is configured to receive plug blades 441-443 and associated blade contacts 421-423, which are stamped and formed so as to pass through contact carrier 425 via the aforementioned slots. In some examples, blade contacts are cylindrical in shape. In other examples, blasé contacts 421-413 are a shape other than cylindrical. In such embodiments, contact carrier 425 defines a physical location for each of the plug blades 441-443 and each associated blade contact 421-423 within rotatable plug assembly 122. Further to the embodiments, the wires of wiring harness 131, which can include wires 431-433, are mechanically coupled to and in electrical communication with each associated blade contact 421-423 for communicating a power signal from rotatable plug assembly 122 to power cable 130, wherein an excess of the wires of wiring harness 131 form the aforementioned service loop.

In still other embodiments, each of plug blades 441-443 and associated blade contacts 421-423 is manufactured as a single piece element within rotatable plug assembly 122. In other embodiments, each of plug blades 441-443 and associated blade contacts 421-423 are manufactured as separate elements and then are electrically and mechanically coupled together prior to insertion through contact carrier 425. Plug blades 441-443 and blade contacts 421-423 can be manufactured from any suitable electrically conducting material, such as, for example, copper alloys including brass and bronze alloys. Contact carrier 425 can be manufactured from any suitable materials, such as, for example flame rated ABS plastic, but also could be manufactured from other rigid or semi-rigid flame rated thermoplastic materials, such as, for example, flame rated polycarbonate plastic or polystyrene plastic.

In some embodiments, rotatable plug assembly 122 of the rotatable electric plug is constructed as follows: plug blades 441-443 and associated blade contacts 421-423 are inserted within contact carrier 425 via slots in contact carrier 425; the wires of wiring harness 131 are electrically and mechanically coupled to an associated one of blade contacts 421-423; a portion of length of the wire of wiring harness 131 are positioned to form a service loop; and rotatable plug assembly 122 (including rotation limiting tab 127 and top assembly flange 125 and bottom assembly flange 126, as seen in FIG. 2) is formed using an overmold methodology to mold rotatable plug assembly 122 around plug blades 441-443, blade contacts 421-423, and contact carrier 425 to encapsulate all or a portion of plug blades 441-443, blade contacts 421-423 and contact carrier 425. In other embodiments, rotatable plug assembly 122 does not include contact carrier 425. In such embodiments, rotatable plug assembly 122 (including rotation limiting tab 127 and top assembly flange 125 and bottom assembly flange 126, as seen in FIG. 2) is formed using an overmold methodology to mold rotatable plug assembly 122 around plug blades 441-443, and blade contacts 421-423 to encapsulate all or a portion of plug blades 441-443 and blade contacts 421-423. In some embodiments, the wires of wiring harness 131 are electrically and mechanically coupled to blade contacts 421-423 by inserting each wire of wiring harness 131 into an associated one of blade contacts 421-423 and crimping portions of blade contacts 421-423. In other embodiments, each wire of wiring harness 131 is electrically and mechanically coupled to an associated blade contact 421-423 by inserting each associated wire of wiring harness 131 into an associated one of blade contacts 421-423 and soldering each wires of wiring harness 131 to the associated blade contact 421-423. In still other embodiments, each wire of wiring harness 131 is electrically and mechanically coupled to an associated blade contact 421-423 by inserting each of wire of wiring harness 131 into an associated one of blade contacts 421-423 and using a combination of crimping and soldering to secure the wires of wiring harness 131 to blade contacts 421-423. In some embodiments, rotatable plug assembly 122 (including rotation limiting tab 127 and top assembly flange 125 and bottom assembly flange 126, as seen in FIG. 2) is formed using an overmold methodology utilizing polyvinyl chloride ("PVC") or other thermoplastic polymer using phthalates as well as other plasticizers.

In other embodiments, rotatable electric plug 110 is constructed as follows: rotatable plug assembly 122, power cable 130 and strain relief 124 are maneuvered so that plug blades 441-443 of rotatable plug assembly 122 and a portion of rotatable plug assembly 122 pass through top opening 226 (FIG. 2, above) of top housing 221 (FIG. 2, above); bottom housing 222 (FIG. 2, above) is maneuvered so that the wires of wiring harness 131 that form the service loop and bottom assembly flange 126 are located within service loop enclosure 330 (FIG. 3, above), and strain relief 124 is located within the cavity formed by lower strain relief area 311 (FIG. 3, above) of bottom housing 222 and an associated region of top housing 221; and coupling bottom housing 222 to top housing 221 using a methodology described above.

Advantages of the rotatable electric plug include reducing strain at a location where the wires of wiring harness 131 couple to blade contacts 421-423, while allowing a large angle of rotation of rotatable plug assembly 122 within the cavity created within top housing 221 and bottom housing 222.

Figure 5:
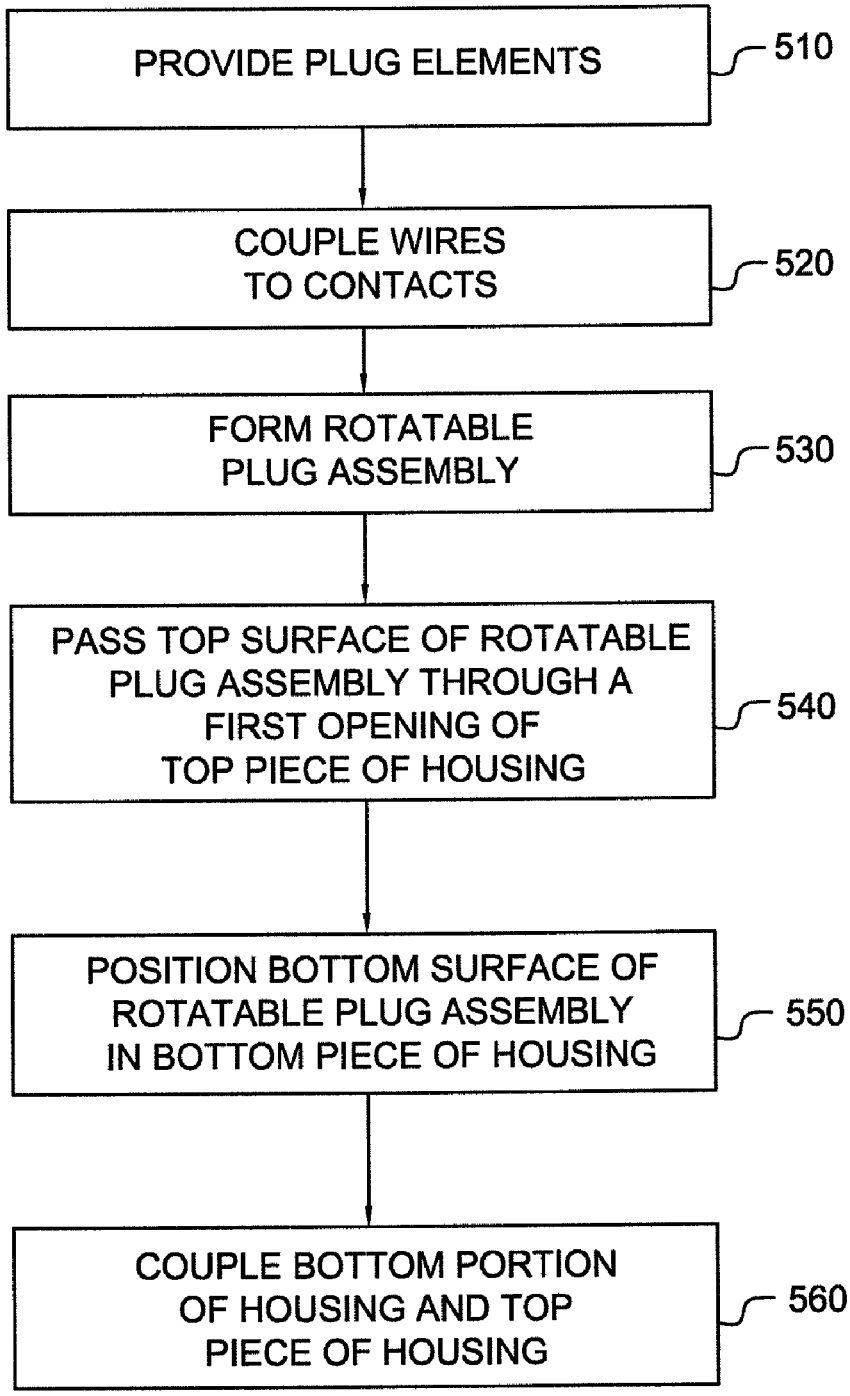
FIG. 5 is a flow chart illustrating an example of a procedure of providing a rotatable electric plug.

FIG. 5 illustrates an example of a method 500 of providing a rotatable assembly. Method 500 is merely exemplary and is not limited to embodiments presented herein. Method 500 can be implemented in many different embodiments or examples not presented herein.

Method 500 of FIG. 5 includes a procedure 510 of providing rotatable plug elements. The rotatable plug elements can include: a top piece of a housing, a bottom piece of the housing, a blade array, and a power cable. The top piece of the housing can be the same as or similar to top housing 221 (FIG. 2); the bottom piece of the housing can be the same as or similar to bottom housing 222 (FIGS. 2-3); the blade array can be the same as or similar to blade array 123 (FIGS. 1-2); and the power cable can be the same as or similar to power cable 130 (FIGS. 1, 2 and 4). In some embodiments the power cable can include wires. The wires can be the same as or similar to wires 431-433 (FIG. 4). In some embodiments, the blade array can include plug blades and blade contacts. The plug blades can be the same as or similar to plug blades 441-443 (FIG. 4); and blade contacts can be the same as or similar to blade contacts 421-423 (FIG. 4). In addition, the rotatable plug elements can further include a contact carrier and a strain relief. The contact carrier can be the same as or similar to contact carrier 425 (FIG. 4); and the strain relief can be the same as or similar to strain relief 124 (FIGS. 1, 2, and 4).

Next, method 500 continues with a procedure 520 of coupling the wires to the contacts. In some embodiments, the contacts can be the same as or similar to the blade contacts. In other embodiments, the contacts can be a contact end of the plug blades, and there are no separate contacts. In some embodiments, the wires are electrically and mechanically coupled to the blade contacts by inserting each of the wires into an associated one of the blade contacts and crimping portions of the blade contacts. In other embodiments, each of the wires is electrically and mechanically coupled to an associated blade contact by inserting each of the wires into an associated one of the blade contacts and soldering each of the wires to the associated blade contact. In still other embodiments, each of the wires is electrically and mechanically coupled to an associated one of the blade contacts by inserting each of the wires into an associated one of the blade contacts and using a combination of crimping and soldering to secure the wires to the blade contacts.

Subsequently, method 500 has a procedure 530 of forming a rotatable plug assembly. In some embodiments, the rotatable plug assembly is constructed as follows: the plug blades and the associated blade contacts are inserted within the contact carrier via slots in contact carrier; the wires are electrically and mechanically coupled to an associated one of the blade contacts; a portion of length of the wires are positioned to form a service loop; and rotatable plug assembly (including a rotation limiting tab, which can be the same as or similar to rotation limiting tab 127, top assembly flange, which can be the same as or similar to top assembly flange 125, and bottom assembly flange, which can be the same as or similar to bottom assembly flange 126, as seen in FIG. 2) is formed using an overmold methodology to mold the rotatable plug assembly around the plug blades, the blade contacts, and the contact carrier to encapsulate all or a portion of the plug blades, the blade contacts, and the contact carrier. In other embodiment, rotatable plug assembly 122 does not include contact carrier 425. In such embodiments, rotatable plug assembly (including a rotation limiting tab, which can be the same as or similar to rotation limiting tab 127, top assembly flange, which can be the same as or similar to top assembly flange 125, and bottom assembly flange, which can be the same as or similar to bottom assembly flange 126, as seen in FIG. 2) is formed using an overmold methodology to mold the rotatable plug assembly around the plug blades and the blade contacts to encapsulate all or a portion of the plug blades and the blade contacts. In some embodiments, the rotatable plug assembly is formed using an overmold methodology utilizing polyvinyl chloride ("PVC") or other thermoplastic polymer using phthalates as well as other plasticizers.

After procedure 530, method 500 continues with a procedure 540 of passing a top surface of the rotatable plug assembly through a first opening of the top piece of the housing. As an example, the first opening can be the same as or similar to top opening 226 (FIG. 2). In the same or other examples, the top surface of the rotatable plug assembly can be the surface at which the plug blades are exposed.

Next, method 500 has a procedure 550 of positioning the bottom surface of the rotatable plug assembly in the bottom piece of the housing. The bottom surface of the rotatable plug assembly can be the surface opposite of the top surface of the rotatable plug assembly. In addition, the bottom portion of the housing can include a service loop enclosure, and a rotation limiting tab stop, which can include rotation limiting tab stop facings. The service loop enclosure can be the same as or similar to service loop enclosure 330 (FIG. 3); the rotation limiting tab stop can be the same as or similar to rotation limiting tab stop 320 (FIG. 3); and the rotation limiting tab stop facings can be the same as or similar to rotation limiting tab stop facings 321 (FIG. 3). The bottom surface of the rotatable plug assembly can be positioned so that the bottom assembly flange of the bottom surface of the rotatable plug assembly can be received by the service loop enclosure.

Subsequently, method 500 continues with a procedure 560 of coupling the bottom piece of the housing with the top piece of the housing. The bottom piece of the housing and the top piece of the housing can be coupled using ultrasonic welding, adhesives, a thermal methodology, and/or screws. In some embodiments, when the bottom piece of the housing and the top piece of the housing are coupled a second opening is formed. The second opening can be configured to allow the power cable to pass through into the housing. In the same or different embodiments, the second opening can be configured to receive the strain relief, thereby allowing the power cable to slide through the strain relief in the second opening.

Although FIG. 5 illustrated various procedures of method 500, it will be understood by those skilled in the art that various changes can be made to method 500 without departing from the scope of the invention. For instance, the order of the procedures can be altered. As one example, procedure 530 can occur before procedure 520; and/or procedure 550 can occur before procedure 540. As another example, not all the plug elements described in reference to procedure 510 above need to be provided at one time. It is possible that the bottom piece of the housing may not be provided until procedure 560 is being performed.

Although aspects of the subject matter described herein have been described with reference to specific embodiments, it will be understood by those skilled in the art that various changes may be made without departing from the scope of the subject matter described herein. Accordingly, the disclosure of embodiments is intended to be illustrative of the scope of the subject matter described herein and is not intended to be limiting. It is intended that the scope of the subject matter described herein shall be limited only to the extent required by the appended claims. To one of ordinary skill in the art, it will be readily apparent that the devices and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the subject matter described herein and claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An electric plug, comprising:

a housing having:

a top piece having an interior surface and an exterior surface and including a first opening; and a bottom piece having an interior surface and an exterior surface, the bottom piece in mechanical communication with the top piece and forming a cavity defined by the interior surface of the top piece and the interior surface of the bottom piece, the cavity including a second opening;

a rotatable plug assembly having a top surface and a bottom surface opposite each other, a first portion of the rotatable plug assembly comprises the bottom surface and is located within the cavity, a second portion of the rotatable plug assembly protruding from the cavity via the first opening;

a blade array including a plurality of plug blades, each plug blade of the plurality of plug blades having an outlet end and a connector end, the connector end of each plug blade located within the rotatable plug assembly, a portion of a remainder portion of each plug blade exiting the top surface of the rotatable plug assembly; and a power cord configured to pass through the second opening of the cavity, the power cord having a plurality of wires, each wire of the plurality of wires including an end, the end of each wire located within the rotatable plug assembly and configured to mechanically couple to and be in electrical communication with the connector end of an associated one of the plurality of plug blades;

wherein the rotatable plug assembly is rotatable relative to the housing without disassembly of the electric plug.

2. The electric plug of claim 1, wherein the second opening is oriented substantially perpendicular to the first opening and wherein the second opening is defined by the interior surface of the top piece and the interior surface of the bottom piece.

3. The electric plug of claim 1, further comprising a strain relief device being substantially hollow, the strain relief device having a cord attachment portion and a housing attachment portion, the housing attachment portion configured to be located within the second opening of the cavity, the cord attachment portion configured to allow the power cord to pass therethrough.

4. The electric plug of claim 1, wherein the first opening of the top piece is substantially circular; and the second portion of the rotatable plug assembly comprises a dimension substantially similar to a dimension of the first opening of the top piece and protrudes from the cavity via the first opening past the exterior surface of the top piece.

5. The electric plug of claim 4, wherein the rotatable plug assembly is configured to include a first flange radiating radially outward from the first portion of the rotatable plug assembly, and wherein the first opening of the top piece circumscribes a perimeter of a portion of the rotatable plug assembly located between the top surface of the rotatable plug assembly and the first flange.

6. The electric plug of claim 1, wherein the interior surface of the bottom piece is configured to include a rotation limiting tab stop protruding from the interior surface of the bottom piece and located substantially opposite the second opening of the cavity, and wherein the rotatable plug assembly further includes a rotation limiting tab protruding outwardly from the bottom surface of the rotatable plug assembly and configured to contact the rotation limiting tab stop when the rotatable plug assembly achieves at least one specific position within the cavity.

7. The electric plug of claim 6, wherein the rotation limiting tab stop includes a plurality of rotation limiting tab stop facings, each of the facings configured to contact the rotation limiting tab stop at a different specific position within the cavity.

8. The electric plug of claim 6, wherein the interior surface of the bottom piece is configured to include a service loop enclosure protruding from the interior surface of the bottom piece, the service loop enclosure configured to enclose the plurality of wires of the power cord.

9. The electric plug of claim 1, wherein the rotatable plug assembly further includes a contact carrier located within the rotatable plug assembly, the contact carrier including a top surface and a bottom surface, the contact carrier having a plurality of slots configured to extend from the top surface of the contact carrier to the bottom surface of the contact carrier, each slot within the contact carrier configured to receive the connector end of an associated one of the plurality of plug blades.

10. The electric plug of claim 9, wherein the blade array includes two blades and the contact carrier includes two slots.

11. The electric plug of claim 9, wherein the blade array includes three blades and the contact carrier includes three slots.

12. An electric plug, comprising:

a housing comprising:

an electrically insulative top shell, the electrically insulative top shell including a circular opening; and an electrically insulative bottom shell mechanically coupled to the electrically insulative top shell, the coupling of the electrically insulative top shell and the electrically insulative bottom shell forming an interior cavity and a power cable hole;

a dynamic plug assembly means within the interior cavity, the dynamic plug assembly means in rotatable communication with the circular opening of the electrically insulative top shell and configured to receive a power cable and facilitate the coupling of the power cable to a plurality of plug blades partially located within the dynamic plug assembly;

a blade array including the plurality of plug blades, each plug blade of the plurality of plug blades having an outlet end and a connector end, the connector end of each plug blade located within the dynamic plug assembly means, a portion of a remainder portion of each plug blade exiting a top surface of the dynamic plug assembly means; and the power cable configured to pass through the power cable hole into the interior cavity, the power cable having a plurality of wires, each wire of the plurality of wires including an end, the end of each wire located within the dynamic plug assembly means and configured to mechanically couple to and be in electrical communication with the connector end of an associated one of the plurality of plug blades;

wherein the dynamic plug assembly means is rotatable relative to the electrically insulative top and bottom shells without disassembly of the electric plug.

13. The electric plug of claim 12, wherein the power cable hole is oriented substantially perpendicular to the circular opening and wherein the power cable hole is defined by an interior surface of the electrically insulative top shell and an interior surface of the electrically insulative bottom shell.

14. The electric plug of claim 12, further comprising a strain relief means, a portion of the strain relief means configured to be located within the power cable hole, the strain relief means further configured to allow the power cable to pass therethrough.

15. The electric plug of claim 12, wherein an interior surface of the electrically insulative bottom shell is configured to include a service loop enclosure protruding therefrom, the service loop enclosure configured to enclose the plurality of wires of the power cable.

16. The electric plug of claim 12, further comprising a contact carrier means to support at least a portion of the plurality of the plug blades.

17. The electric plug of claim 16, wherein the blade array includes two blades and the contact carrier means includes two slots.

18. The electric plug of claim 16, wherein the blade array includes three blades and the contact carrier means includes three slots.

19. A method for providing an electric plug, comprising:

providing plug elements;

coupling wires of a power cable to blade contacts of plug blades;

providing a rotatable plug assembly;

passing a top surface of the rotatable plug assembly through a first opening of a top piece of a housing; and coupling a bottom piece of the housing and the top piece of the housing together so that a second opening is formed between the bottom piece of the housing to the top piece of the housing, and so that a bottom surface of the rotatable plug assembly is adjacent to the bottom piece of the housing, the top and bottom surfaces of the rotatable plug assembly being opposite each other;

wherein:

the rotatable plug assembly comprises a blade array having the blade contacts of the plug blades, each of the plug blades being mechanically coupled to and in electrical communication with an associated one of the blade contacts;

the bottom piece of the housing comprises:

a tab stop configured to limit a rotation of the rotatable plug assembly;

the power cable passes through the second opening; and the rotatable plug assembly is rotatable relative to the housing without disassembly of the housing.

20. The method of claim 19, wherein:

coupling the bottom piece of the housing to the top piece of the housing further comprises positioning a strain relief in the second opening between the bottom piece of the housing and the top piece of the housing; and the power cable passes through the stain relief.

* * * * *